United States Patent [19]

Nakano et al.

[11] Patent Number: 4,806,889

[45] Date of Patent: Feb. 21, 1989

[54] CERAMIC FILTER

[75] Inventors: Fumihito Nakano, Narita; Kiyoshi Hagawa, Chiba; Kenji Endo, Narita; Kohei Wada, Osaka; Katsuya Jindou, Kamagaya, all of Japan

[73] Assignee: TDK Corporation, Tokyo, Japan

[21] Appl. No.: 187,430

[22] Filed: Apr. 28, 1988

[30] Foreign Application Priority Data

Dec. 28, 1987 [JP] Japan ..... 62-336653

[51] Int. Cl.[4] ..... H01P 1/205; H01P 1/208

[52] U.S. Cl. ..... 333/202; 333/203; 333/206; 333/235

[58] Field of Search ..... 333/202, 203, 206–212, 333/219, 222–226, 235

[56] References Cited

U.S. PATENT DOCUMENTS

| | | | |
|---|---|---|---|
| 3,505,618 | 4/1970 | McKee . | |
| 4,255,729 | 3/1981 | Fukasawa et al. | 333/202 |
| 4,431,977 | 2/1984 | Sokola et al. | 333/222 X |
| 4,464,640 | 8/1984 | Nishikawa et al. | 333/203 X |
| 4,607,242 | 8/1986 | Cozzie | 333/208 X |
| 4,692,726 | 9/1988 | Green et al. | 333/206 |
| 4,733,208 | 3/1988 | Ishikawa et al. | 333/202 |
| 4,745,379 | 5/1988 | West et al. | 333/206 |

FOREIGN PATENT DOCUMENTS

| | | |
|---|---|---|
| 61-43285 | 12/1986 | Japan . |
| 61-43287 | 12/1986 | Japan . |
| 63-8642 | 2/1988 | Japan . |

*Primary Examiner*—Marvin L. Nussbaum

*Attorney, Agent, or Firm*—Fleit, Jacobson, Cohn & Price

[57] ABSTRACT

A dielectric ceramic body for use in a band-pass filter. The ceramic body has a plurality of through holes formed to extend transversely from one side surface to another side surface which is opposite to the one side surface and arranged in series along a longitudinal direction of the body. Slits are formed on one of the aforementioned two side surfaces between respective two holes. The slits have depths which increase toward end portions of the ceramic body.

15 Claims, 11 Drawing Sheets

CERAMIC FILTER

BACKGROUND OF THE INVENTION

1. Field of the Invention

The present invention relates to a dielectric ceramic body which is adapted to be used for a ceramic band-pass filter. More particularly, the present invention pertains to a dielectric ceramic body of a substantially cuboidal configuration having a conductive or short-circuited surface which is coated with a layer of a conductive material and an open surface which is opposite to the conductive surface and is not coated with a conductive material, one of the conductive and open surfaces being formed with a plurality of spaced apart slits which determine coupling properties in the body.

2. Description of the Prior Art

Conventionally, a ceramic filter has been structured to include a plurality of cylindrical ceramic bodies which are arranged in series and electrically connected to provide a transmitter resonator and a receiver resonator, respectively. This type of ceramic filter is disclosed for example by the U.S. Pat. No. 4,255,729 issued to A. Fukasawa et. al. on Mar. 10, 1981. The known type of ceramic filter is found disadvantageous in that it requires a lot of labors in manufacture.

The U.S. Pat. No. 3,505,618 issued to F. B. L McKee on Apr. 7, 1970 discloses a filter which is made of a dielectric body of a substantially cuboidal configuration. The body is formed with a plurality of through holes which are arranged in series and extend from one surface of the body to the opposite surface. The body is covered by a layer of a conductive material such as silver. The holes have surfaces which are covered by a conductive material and conductive terminals may be inserted into selected holes to provide an input and an output.

The patent proposes to provide the body with polystyrene, however, the body may be made of a dielectric ceramic material as disclosed by the U.S. Pat. No. 4,464,640 issued to T. Nishikawa et. al. on Aug. 7, 1984. In the filter structure proposed by Nishikawa et. al., the ceramic body is covered by a conductive material except a surface where one ends of the holes are opened. The surface which is not covered by the conductive material may be referred as the open surface and the surface which is covered by the conductive material and opposite to the open surface may be referred as the short-circuited surface. In order to provide a desired coupling between each two adjacent holes, a slit is formed between the holes. As shown in the U.S. Pat. No. 4,431,977 issued to R. L. Sokola et. al. on Feb. 14, 1984, the ceramic body may be of an elongated configuration and a plurality of holes may be formed and arranged in series in the axial direction of the body. In the structure as shown in the patent to Sokola et. al., a slit is formed between each two adjacent pair of the holes.

This type of ceramic filters are useful in that it can be readily assembled and less expensively manufactured. The number of the holes may be appropriately determined to obtain a desired function. In this type of ceramic filter, a desired resonating frequency is obtained through an adjustment of the volume of the dielectric material between the conductive layers on the surfaces of each two adjacent holes or the conductive layer on the surface of each hole and the outer surface of the ceramic body. For the purpose, the thickness of the ceramic body or the distance between the open surface and the short-circuited surface is appropriately changed to thereby change the lengths of the holes. For example, atan axially end portion, the thickness of the ceramic body may be reduced to provide a shortened hole length or a piece of dielectric material may be added to an appropriate portion of the ceramic body.

It should however be noted that the conventional method for obtaining a desired resonating frequency is inconvenient in that the number of parts and the labor for the manufacture are undesirably increased. The patent to Sokola et. al. proposes to cover even the surface opposite to the short-circuited surface except the area around each hole to provide a desired coupling. It should however be noted that the structure as proposed by Sokola et. al. is not satisfactory, either.

SUMMARY OF THE INVENTION

It is therefore an object of the present invention to provide a dielectric ceramic body for a ceramic filter which has a versatility in obtaining a desired filter property.

Another object of the present invention is to provide a ceramic filter having a dielectric ceramic body formed with a plurality of through holes extending from one surface to another surface opposite to the one surface and a slit formed in one of the said surfaces between two adjacent holes, the filter having a versatility in obtaining a desired property.

According to the present invention, the above and other objects can be accomplished by a dielectric ceramic body for a ceramic filter, said body being of a cuboidal configuration having first side surface and a second side surface which is opposite to said first side surface, a plurality of holes arranged in series along a length of said body to extend from said first side surface to said second side surface and opening at the opposite ends to said first and second side surfaces, a plurality of slits formed at one of said first and second side surfaces and located one between each two adjacent pair of said holes, a first conductive layer provided at least on one of said first and second surfaces, a second conductive layer provided on an interior wall of each hole, said slits having depths which change so that the depth of the slit at an end portion of the ceramic body is greater than the depth of the slit at an intermediate portion of the ceramic body.

More specifically, the ceramic body may be an elongated cuboidal configuration having opposite end portions with the first and second side surfaces extending between said end portions, at least a predetermined number of slits from each end having lengths which increase toward said end portion of the ceramic body so that bottom portion of the slits are located substantially along a parabolic curve. In case where the ceramic body has five holes, there are formed three slits in the body. The slits at the opposite end portions then have depths which are greater than the depth of the central slit. In case where the number of the slits is four, the central two slits may have substantilly the same depth and the outer two slits may have depths which are greater than the depths of the central slits.

In case where the number of slits is five, the depths of the slits are increased toward each end so that the bottoms of the slits are located along a elliptic or parabolic curve. In a dielectric ceramic body having more slits, at least three slits from each end are increased in depth toward the end of the body and the remaining slits may have substantially the same depths or the depths of the remaining slits may be increased gradually toward each end.

In general, the ceramic body for the filter is required to have a stronger coupling at the hole located at an axially outer portion than at the hole located at an axially inner portion of the body The slit depths described above provide desirable property to meet the above requirement. The increase in the depths of the slits toward each end of the body provides a versatility in obtaining a desired coupling property at each hole of the ceramic filter. It is preferable that the slit depth change is substantially symmetrical with respect to the axial center of the ceramic body. The ceramic body may have a decreased thickness at each end for the convenience of attaching a terminal.

The above and other objects and features of the present invention will become apparent from the following descriptions of preferred embodiments taking reference to the accompanying drawings.

DESCRIPTION OF THE PREFERRED EMBODIMENT

Figure 1:
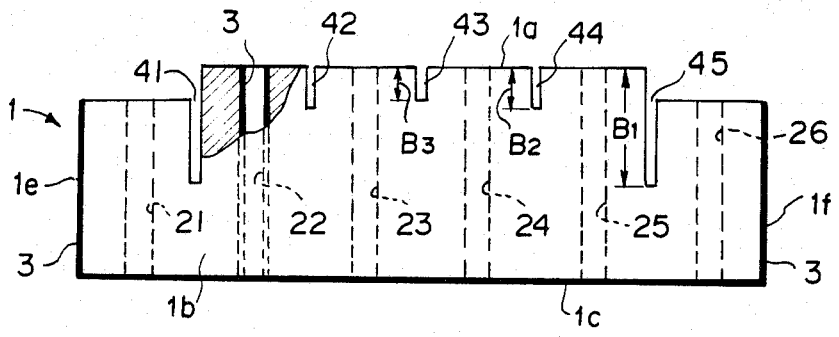
FIG. 1 is a side view of a dielectric ceramic body in accordance with one embodiment of the present invention.
Figure 15:
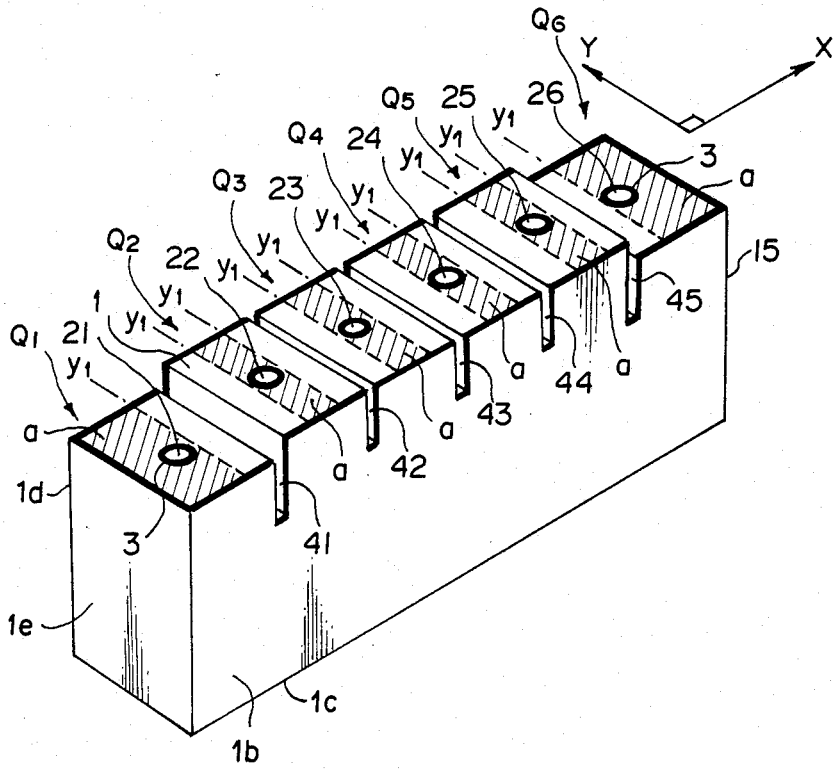
FIG. 15 is a perspective view of a ceramic body showing a manner of adjusting the resonant frequency of each resonator of the filter.

Referring to the drawings, particularly to FIG. 1 together with FIG. 15, there is shown a dielectric ceramic body 1 of a substantially cuboidal configuration having four side surfaces 1*a*, 1*b*, 1*c* and 1*d* and two end surfaces 1*e* and 1*f*. The ceramic body 1 is formed with six through holes 21, 22, 23, 24, 25 and 26 which extend from the top or side surface 1*a* to the bottom or side surface 1*c* and arranged in series in the axial direction of the body as shown by an arrow X in FIG. 15. The ceramic body 1 is further formed at the top surface 1*a* with slits 41, 42, 43, 44 and 45 which are located between respective pairs of the holes 21, 22, 23, 24, 25 and 26. Each of the slits extends in the transverse direction or the direction shown by an arrow Y in FIG. 15.

The ceramic body is covered at the side surfaces 1*b*, 1*c* and 1*d* and the end surfaces 1*e* and 1*f* with an electrically conductive material such as silver which thus provides a conductive layer 3. Each of the holes 21, 22, 23, 24, 25 and 26 is also coated by a layer 3 of a conductive material such as silver. The side or top surface 1*a* is left uncoated so that the surface 1*a* provides an open surface. The side or bottom surface 1*c* provides a short-circuited surface. The holes 21, 22, 23, 24, 25 and 16 respectively provide resonating stages $Q_1$, $Q_2$, $Q_3$, $Q_4$, $Q_5$ and $Q_6$ of a ceramic filter which is obtained from the ceramic body 1.

In FIG. 1, it will be noted that the slits 41 and 45 which are located at the axially outermost positions have the same depth $B_1$ whereas the slits 42 and 44 which are second from the axial end have the same depth $B_2$. The axially central slit 43 has a depth $B_3$ which is smaller than the depths $B_1$ and $B_2$. Most preferably, the depth $B_2$ for the slits 42 and 44 and the depth $B_3$ for the slit 43 are determined in relation to the depth $B_1$ for the axially outermost slits 41 and 45 by the formula $$B_2=k\times B_1,\ B_3=k\times B_2$$

where k is a proportional coefficient having a value between 0.65 and 0.95.

Figure 2:
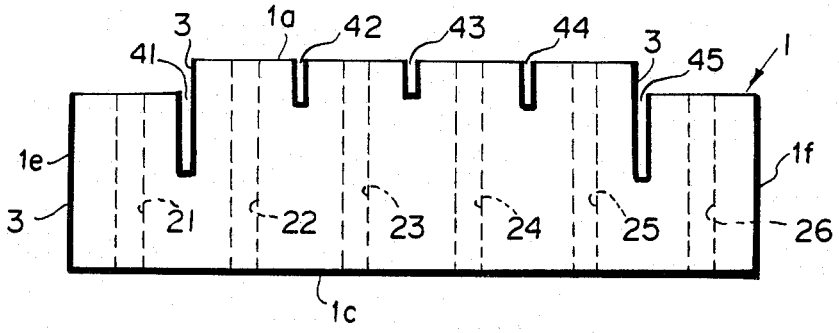
FIG. 2 is a side view similar to FIG. 1 but showing a modified form.
Figure 3:
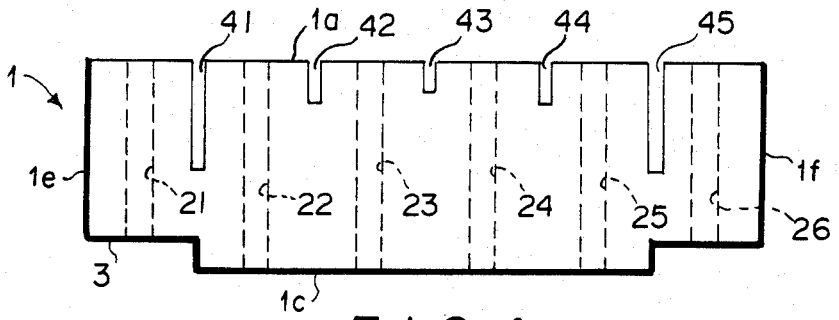
FIGS. 3 and 4 are side views showing further modifications.
Figure 4:
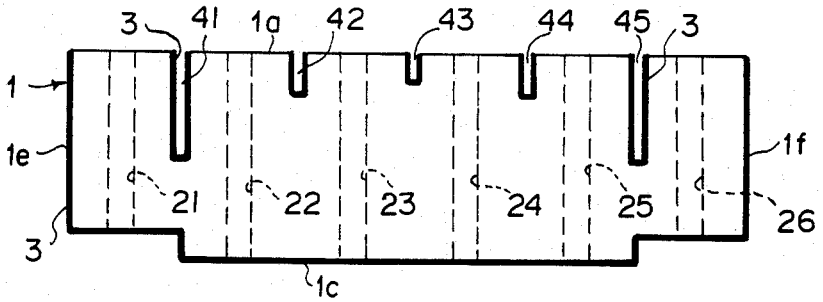
Figure 5:
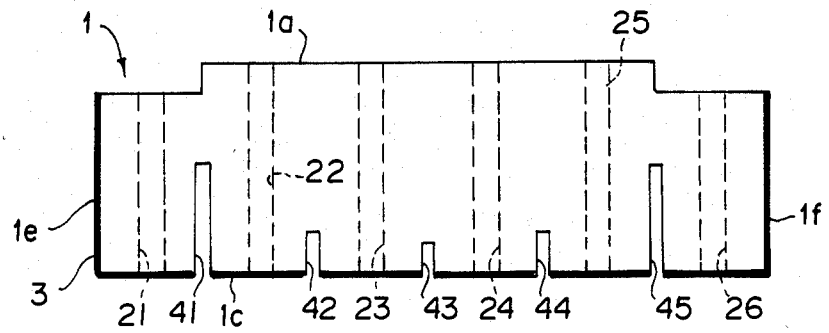
FIG. 5 is a side view showing a dielectric ceramic body having slits in the short-circuited surface.
Figure 6:
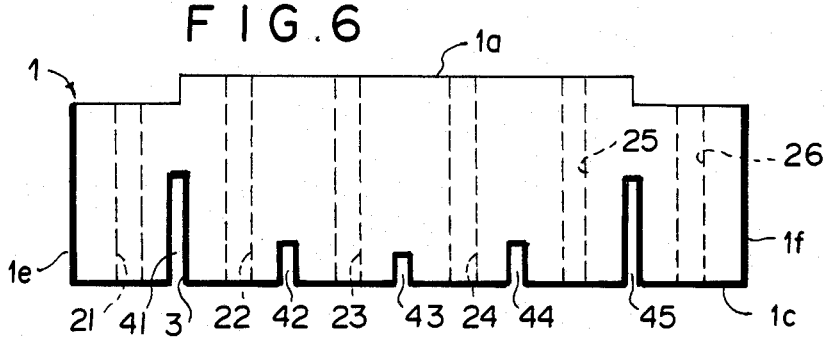
FIG. 6 is a side view showing a modification of the ceramic body shown in FIG. 5.
Figure 7:
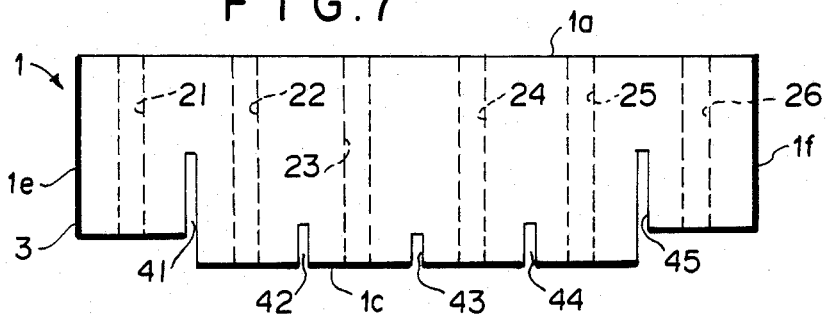
FIGS. 7 and 8 are side views showing further modifications.
Figure 8:
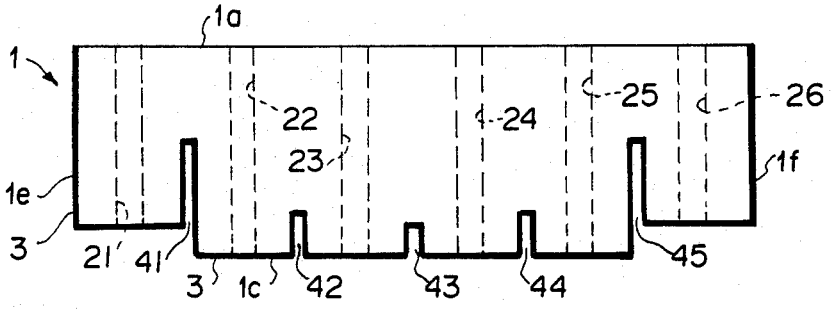

FIG. 2 shows another example of the ceramic body 1. In this example, the slits 41, 42, 43, 44, 45 and 46 have walls which are coated with a layer 3 of a conductive material such as silver. In this example, the depths of the slits 41, 42, 43, 44, 45 and 46 are determined in the same manner as in the previous example. The configuration of the ceramic body 1 in the examples shown in FIGS. 1 and 2 is such that the thickness of the body 1 is reduced at portions axially outside the outermost slits 41 and 45 by forming stepped portions on the top surface 1*a*. FIG. 3 shows an example in which the ceramic body 1 is different from the ceramic body 1 of the example shown in FIG. 1 in that the body 1 in FIG. 3 has stepped portions on the bottom surface 1*c* to provide the portions of reduced thickness. Similarly, the ceramic body 1 shown in FIG. 4 is different from the body 1 shown in FIG. 2 in that the body 1 in FIG. 4 has stepped portions on the bottom surface 1*c* to provide the portions of reduced thickness. In the examples of FIGS. 3 and 4, the depths of the slits 41, 42, 43, 44, 45 and 46 are determined in the same manner as in the examples of FIGS. 1 and 2.

FIGS. 5 through 8 show examples which correspond respectively to the examples shown in FIGS. 1 through 4. The examples in FIGS. 5 through 8 are different from the examples in FIGS. 1 through 4 in that the slits 41, 42, 43, 44, 45 and 46 are formed not in the top surface 1*a* but in the bottom surface 1*c*. In these examples, the depths of the slits 41, 42, 43, 44, 45 and 46 are determined as in the examples in FIGS. 1 through 4.

Figure 9:
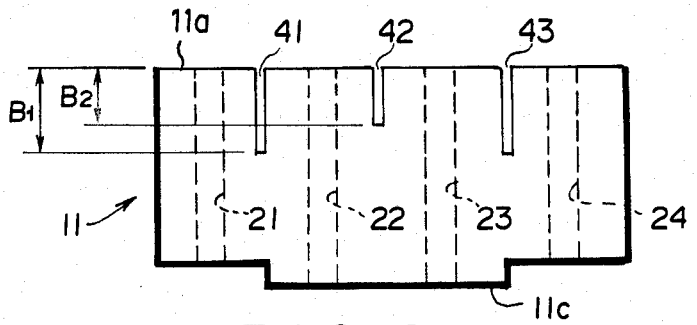
FIGS. 9 and 10 are diagrammatical illustrations of ceramic bodies having three slits.

Referring to FIG. 9, there is shown a dielectric ceramic body 11 which has four through holes 21, 22, 23 and 24 arranged in series in the axial direction of the body and extending from the top surface 11*a* to the bottom surface 11*c*. As in the previous embodiments, the body 11 is coated with a layer of a conductive material on the external surfaces except the top surface 11*a*. Further, the inside wall surfaces of the holes 21 through 24 are also coated with a layer of a conductive material. In this embodiment, the ceramic body 11 has three slits 41, 42 and 43 which are located respectively between the holes 21, 22, 23 and 24. The slits 41 and 43 have substantially the same depth $B_1$ and the slit 42 has a depth $B_2$ which is smaller than the depth $B_1$. Preferably, the depth $B_2$ is determined in accordance with the formula $$B_2 = k \times B_1$$

where k is a constant having a value between 0.65 and 0.95.

Figure 10:
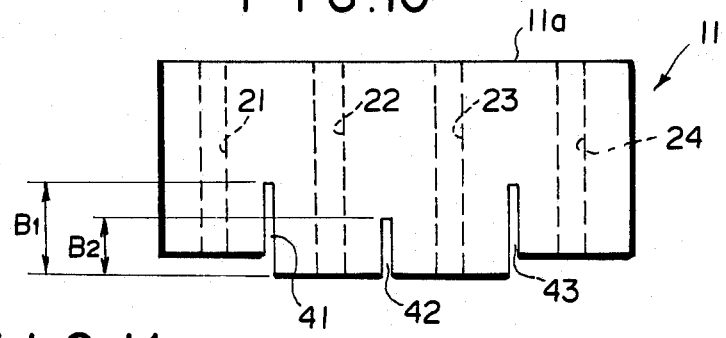

FIG. 10 shows a further example of the dielectric ceramic body 11 which is substantially identical with the body 11 shown in FIG. 9. In the example shown in FIG. 10, the slits 41, 42 and 43 are formed in the short-circuited surface 11*c*. The depths of the slits 41, 42 and 43 are determined in the same manner as in the example shown in FIG. 9.

Figure 11:
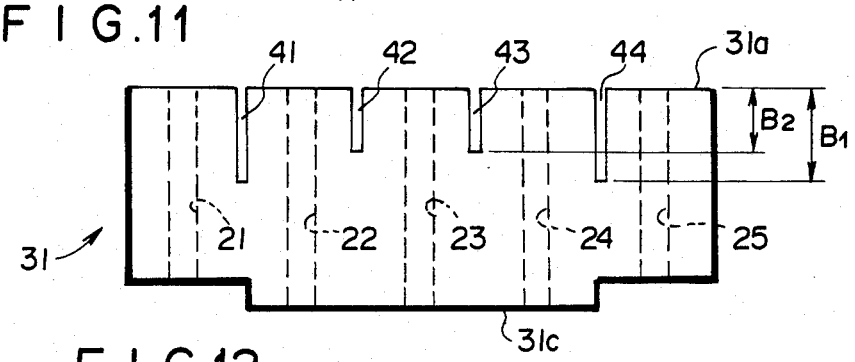
FIGS. 11 and 12 are diagrammatical illustrations of ceramic bodies having four slits.

FIG. 11 shows a dielectric ceramic body 31 having a top surface 31*a* and a bottom surface 31*c*. Through holes 21, 22, 23, 24 and 25 are formed to extend from the top surface 31*a* to the bottom surface 31*c* and arranged in series in the axial direction of the body 31. The outer surface of the ceramic body 31 is coated with a layer of an electrically conductive material. Further, the inside walls of the holes 21, 22, 23, 24 and 25 are also coated with a layer of a conductive material. Four slits 41, 42, 43 and 44 are formed in the top surface 31*a* and located respectively between adjacent pairs of the holes 21, 22, 23, 24 and 25.

The axially outer slits 41 and 44 have substantially the same depth $B_1$ and the inner slits 42 and 43 have substantially the same depth $B_2$ which is smaller than the depths $B_1$ of the outer slits 41 and 44. Preferably, the depth $B_2$ is determined in accordance with the formula $$B_2 = k \times B_1$$

where k is a constant having a value between 0.65 and 0.95.

Figure 12:
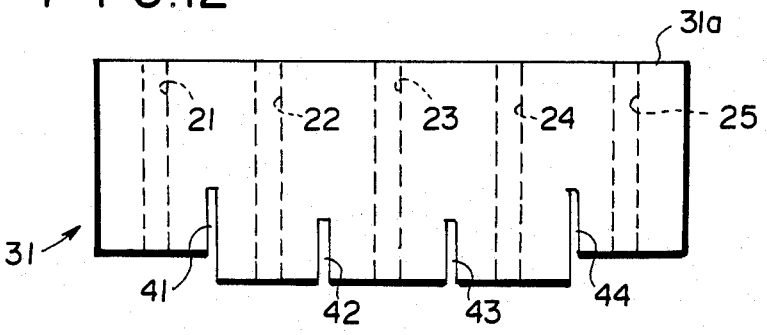

FIG. 12 shows another example of the ceramic body 31 which is different from the ceramic body in FIG. 11 in that the slits 41 through 44 are formed in the coductively coated or short-circuited surface 31*c*. The depths of the slits 41 through 44 are determined substantially in the same manner as in the example of FIG. 11.

In the examples shown in FIGS. 9 through 12, the slits have depths which are so determined that the bottom portions of the slits are arranged substantially along an elliptical curve.

Figure 13:
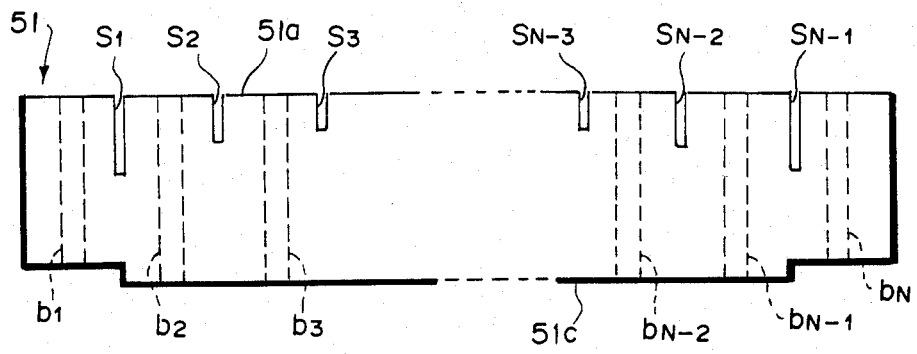
FIGS. 13 and 14 are diagrammatical illustrations of ceramic bodies having more than six slits.

FIG. 13 shows a further embodiment of the present invention in which the ceramic body 51 has top surface 51*a* and a bottom surface 51*c* and formed with holes extending from the top surface 51*a* to the bottom surface 51*c*. In this example, the number of the holes is N so that the holes are designated from one axial end of the body by the reference characters $b_1, b_2, b_3 \ldots b_{n-2}, b_{n-1}$ and $b_n$. The holes have inside walls which are coated with layers of a conductive material. The ceramic body 51 is formed at the top surface 51*a* with slits $s_1, s_2, s_3 \ldots s_{-3}, s_{n-2}$ and $s_{n-1}$ which are located between respective adjacent pairs of the holes.

The slits $S_1, s_2, s_3 \ldots s_{N-3}, s_{N-2}$ and $s_{N-1}$ respectively have depths $B_1, B_2, B_3 \ldots B_{N-3}, B_{N-2}$ and $B_{N-1}$ which are determined in accordance with the formula $$B_m \text{ (or } B_{N-m}) = k_m \times B_{m-1}$$

where m is a largest integer which does not exceed $(N-1)/2$ and $k_m$ is a proportional coefficient which has a value between 0.65 and 0.95 in case where m is 2 and $N-1$ and a value between 0.8 and 1.0 in case where m is 3 to $N-2$. Most preferably, the value 0.8 is adopted to determine the depth of the slit $s_3$ or $s_{N-3}$. Then, at least three slits from the axially outer end have depths which change so that the bottom portions of the slits are laid substantially along a parabolic curve.

Figure 14:
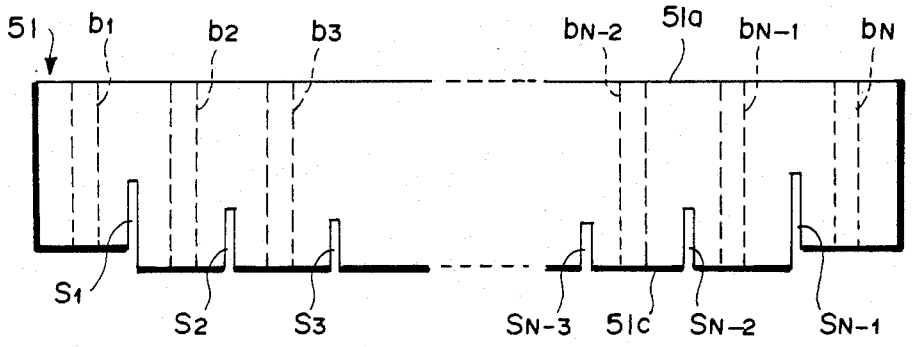

FIG. 14 shows a further example which is similar to the example shown in FIG. 13 but has slits $s_1$ through $s_{N-1}$ formed in the short-circuited surface 51*c*. The depths of the slits $s_1$ through $s_{N-1}$ are determined as in the example shown in FIG. 13. Where the surface having the slits is formed with stepped portions, the depth of the slit is measured from the highest part of the surface adjacent to the slit.

Figure 25:
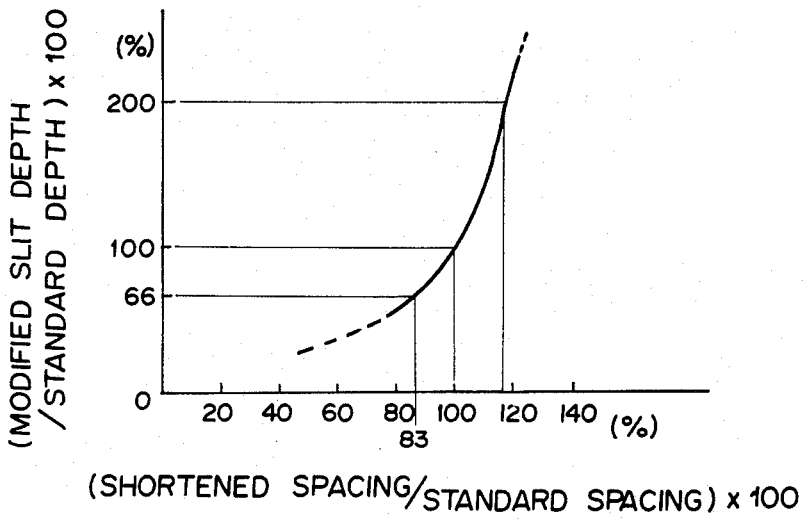
FIG. 25 is a diagram showing the relationship between the spacings of the holes and the depths of the slits; and, FIG. 26 is a diagram showing the effect of the conductive coating in the slit.

The manner of determining the depths of the slits is based on the assumption that the holes have the same diameter and arranged with the same spacings. In case where the spacings between respective adjacent pairs of holes are not uniform, the slit depths must be modified. In case where the hole spacing is decreased with the same hole diameter, the coupling becomes stronger. For example, where the spacing between the holes $b_1$ and $b_2$ and the spacing between the holes $b_{N-1}$ and $b_N$ are smaller than the other spacings in the embodiment of FIG. 13, the coupling at the end portions will become stronger if the depths of the slits $s_1$ and $s_{N-1}$ are unchanged. Therefore, the slit depths must be modified in accordance with the relationship as shown in FIG. 25. As an example, as shown in FIG. 25, where the hole spacing is decreased to 83% of the standard spacing, the slit depth should be decreased to 66% of the standard depth which is the depth of the slit required for obtaining the desired coupling with the standard hole spacing.

Figure 26:
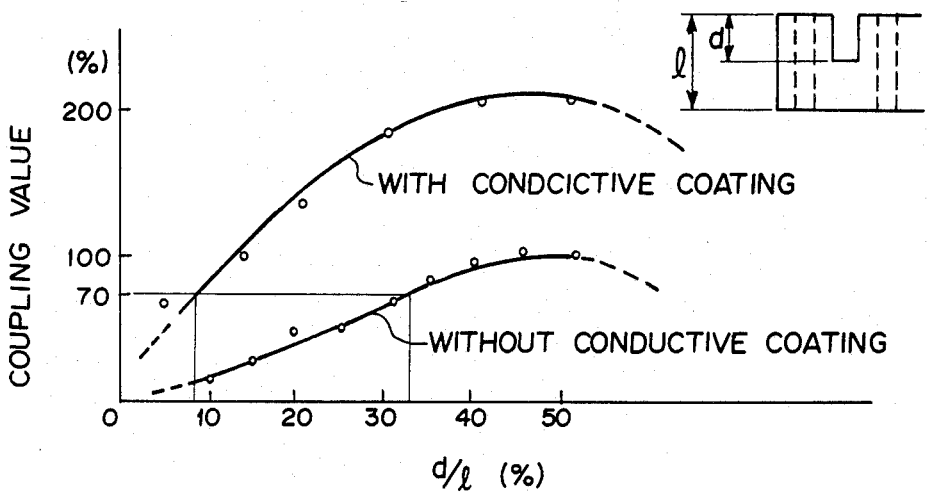

In case where the slits are coated with conductive layers, slits can be of smaller depths for obtaining the same coupling property. FIG. 26 shows the relationship between the relative value of the inter-stage coupling and the depth of the slit with and without the conductive coating. In FIG. 26, the depth of the slit is designated as a ratio of the depth d and the thickness 1 of the ceramic body. Where the slit has the conductive coating, the slit depth may be modified in accordance with the relationship as shown in FIG. 26. For example, in order to obtain the relative coupling value of 70%, the slit depth must be 33% if the slit does not have a conductive coating, but the slit depth can be as small as 8% where the slit has a conductive coating.

Figure 16:
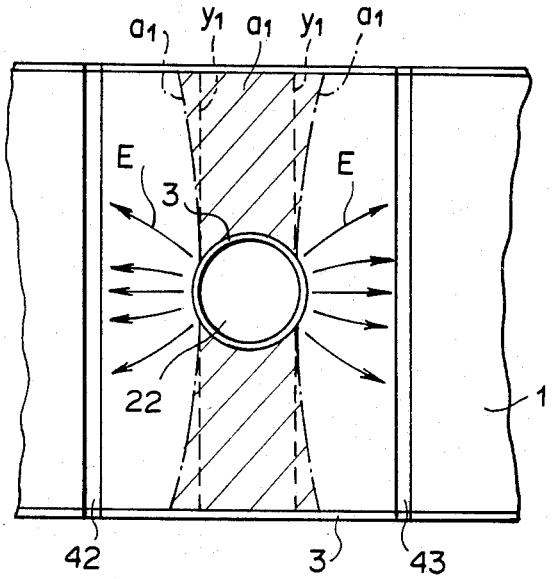
FIGS. 16, 17 and 18 are fragmentary plan views showing manners of adjusting the resonant frequency of each resonator of the filter.
Figure 17:
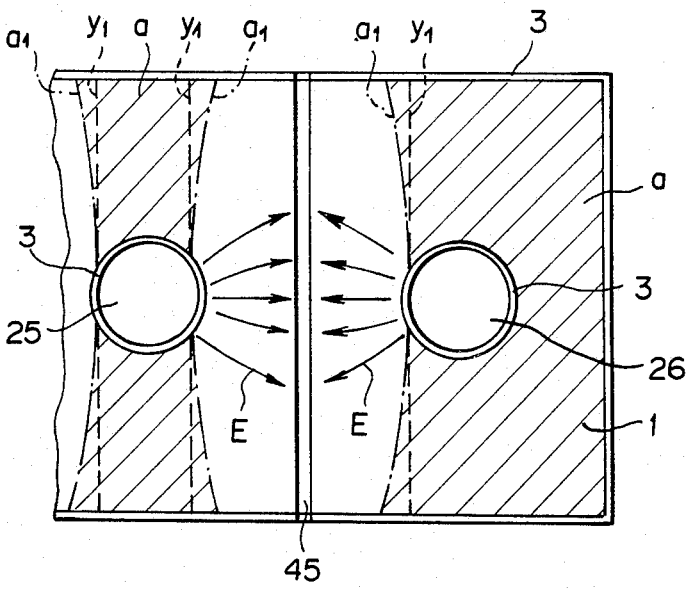

Referring to FIG. 15, there is shown regions which are used for an adjustment of the resonating frequency. In the example shown in FIG. 15, shadowed areas which are encircled by transverse tangential lines $y_1$ of the holes are the adjustment regions a. As shown in FIGS. 16 and 17, the coupling electric field E is strongest in the axial direction X of the ceramic.body along which the holes are arranged and the field is decreased toward the transverse direction Y. In the intermediate resonating stage $Q_2$ to $Q_5$, the inter-stage coupling is produced at the opposite sides of the hole. Thus, the adjustment region a is defined by the transverse tangential lines $y_1$ drawn at the opposite sides of the hole. At the end coupling stages $Q_1$ and $Q_6$, the inter-stage coupling is produced only at one side of the hole. Thus, the adjustment region is defined by a single transverse tangential line $y_1$ of the hole drawn at the axially inner side of the ceramic body. It is understood that the coupling electric field is curved in the transverse direction as shown by lines $a_1$ in FIGS. 16 and 17, however, in actual practice, the adjustment region can conveniently be defined by the straight lines $y_1$.

Figure 18:
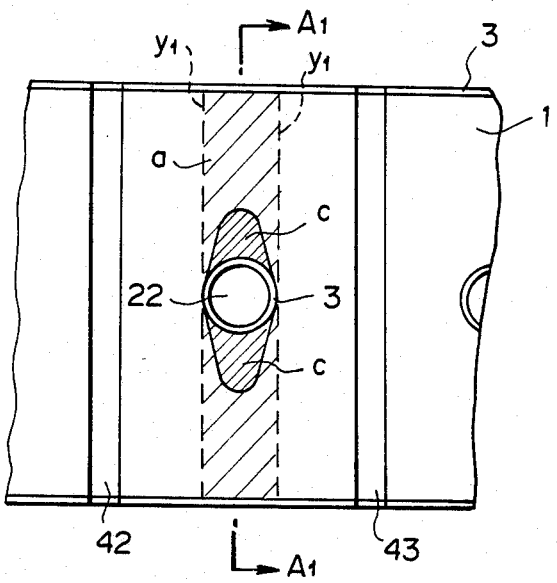
Figure 19:
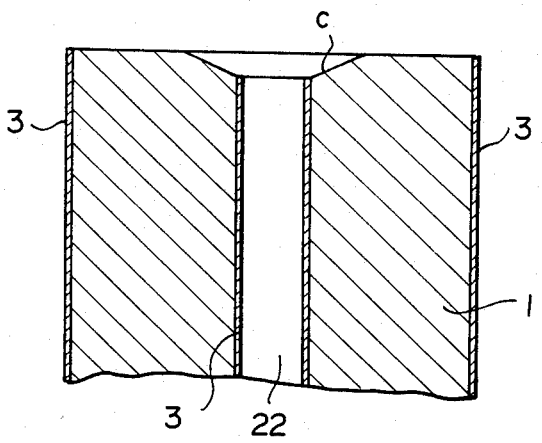
FIG. 19 is a fragmentary sectional view taken along the line $A_1$—$A_1$ in FIG. 18 to show the manner of adjusting the resonant frequency.
Figure 20:
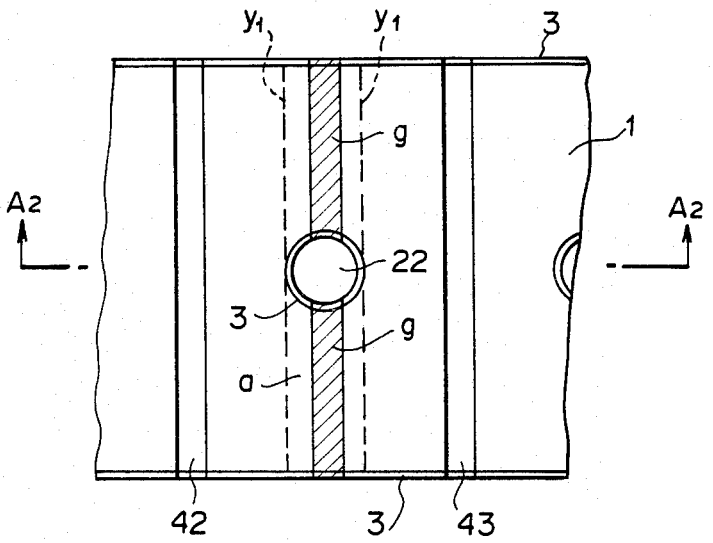
FIG. 20 is a fragmentary plan view showing a further manner of adjusting the resonant frequency.
Figure 21:
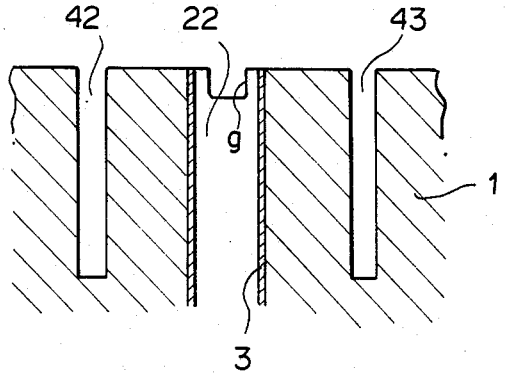
FIG. 21 is a sectional view taken along the line $A_2$—$A_2$ in FIG. 20.
Figure 22:
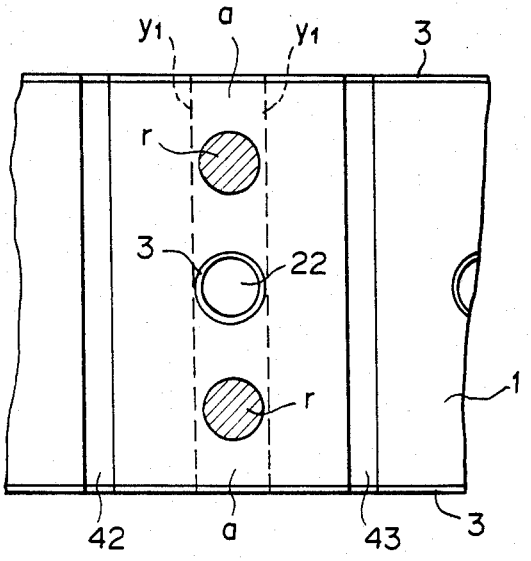
FIGS. 22 and 23 are fragmentary plan view showing further different manners of adjusting the resonant frequency.
Figure 23:
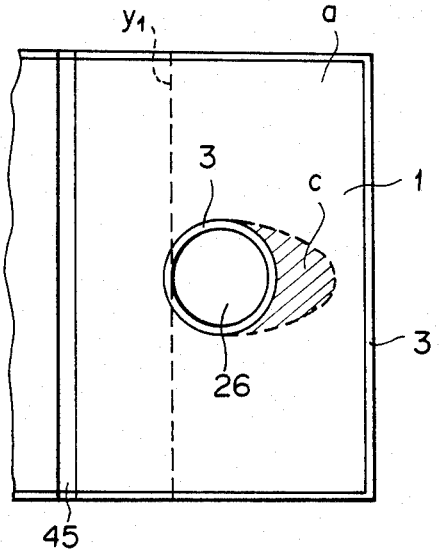
Figure 24:
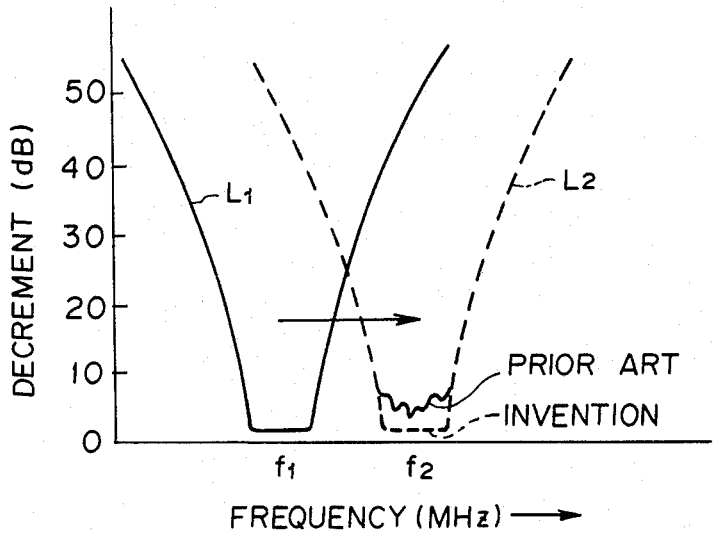
FIG. 24 is a diagram showing the result of resonant frequency adjustment in accordance with the present invention.

In order to adjust the resonating frequency, the dielectric material in the adjustment region a is appropriately removed for example by forming a chamfered configuration c as shown in FIGS. 18 and 19. Alternatively, the dielectric material may be removed by forming a groove g as shown in FIGS. 20 and 21. As another example, circular recesses r may be formed in the adjustment region a as shown in FIG. 22. For the outermost hole 21 or 26, the chamfered portion may be formed as shown in FIG. 23 at the axially outer side of the hole. Referring to FIG. 24, it will be noted that the resonating frequency is shifted from the value $f_1$ to the value $f_2$ by the removal of the dielectric material as described above. It should however be noted that if the material is removed along the whole periphery of the hole, there will be fluctuations in the value of decrement. According to the manner of the adjustment described above, such fluctuations can be avoided.

The invention has thus been shown and described with reference to specific embodiments, however, it should be noted that the invention is in no way limited to the details of the illustrated structures but changes and modifications may be made without departing from the scope of the appended claims.

We claim:

1. A dielectric ceramic body for a ceramic filter, said body being of a cuboidal configuration having first side surface and a second side surface which is opposite to said first side surface, a plurality of holes arranged in series along a length of said body to extend from said first side surface to said second side surface add opening at the opposite ends to said first and second side surfaces, a plurality of slits formed at one of said first and second side surfaces and located one between each two adjacent pair of said holes, a first conductive layer provided at least on one of said first and second surfaces, a second conductive layer provided on an interior wall of each hole, said slits having depths which change so that the depth of the slit closer to an end portion of the ceramic body is greater than the depth of the slit closer to a center portion of the ceramic body.

2. A dielectric ceramic body in accordance with claim 1 in which said body has opposite end portions, said first and second side surfaces extending between said end portions, at least a predetermined number of said slits counted from each end portion having depths which increase toward said end portion of the ceramic body so that bottom portions of the slits are laid substantially along a parabolic curve.

3. A dielectric ceramic body in accordance with claim 1 in which said body has opposite end portions, said first and second side surfaces extending between said end portions, said slits having depths which increase toward said end portion of the ceramic body so that bottom portions of the slits are laid substantially along an annular curve.

4. A dielectric ceramic body in accordance with claim 1 in which said slits are formed in said one of the first and second surfaces.

5. A dielectric ceramic body in accordance with claim 1 in which said slits are formed in the other of the first and second surfaces.

6. A dielectric ceramic body in accordance with claim 1 in which the number of the slits is five with two outermost slits having substantially the same depth $B_1$, two slits which are adjacent to said outermost slits having substantially the same depth $B_2$, the center slit having a depth $B_3$, the depths $B_1$, $B_2$ and $B_3$ being determined substantially in accordance with formulae $$B_2=k\times B_1,\ B_3=k\times B_2$$

where k is a proportional coefficient having a value between 0.65 and 0.95.

7. A dielectric ceramic body in accordance with claim 1 in which the number of the slits is three with two outer slits having substantially the same depth $B_1$ and the central slit having a depth $B_2$ which is determined with respect to the depth $B_1$ in accordance with a formula $$B_2=k\times B_1$$

where k is a proportional coefficient having a value between 0.65 and 0.95.

8. A dielectric ceramic body in accordance with claim 1 in which the number of slits is N and the depths of the slits are determined in accordance with formula $$B_m\ (or\ B_{N-m})=k_m\times B_{m-1}$$

$B_m$ is the depth of the slits with the suffix m representing the order of the slit counted from one end of the body, m being a largest integer which does not exceed $(N-1)/2$, and $k_m$ is a proportional coefficient having a value between 0.65 and 0.95 in case where m is 2 and $N-1$ and a value between 0.8 and 1.0 in case where m is 3 to $N-2$.

9. A dielectric ceramic body in accordance with claim 1 in which all of said slits are coated with layers of a conductive material.

10. A dielectric ceramic body in accordance with claim 1 in which all of said slits are not coated with layers of a conductive material.

11. A dielectric ceramic body in accordance with claim 1 in which at least one of said slits is coated with a conductive material, said one slit being decreased in depth than a depth as determined for a slit having no conductive coating.

12. A dielectric ceramic body in accordance with claim 1 in which said holes are arranged with uniform spacings.

13. A dielectric ceramic body in accordance with claim 1 in which at least two adjacent holes are arranged with a smaller spacing than the other hole spacings, the slit between said two adjacent holes being decreased in depth than a depth as determined for a uniform hole spacing.

14. A dielectric ceramic body in accordance with claim 1 in which dielectric material is removed from said body at the other of the first and second side surfaces in an area encircled by a pair of transverse tangent lines drawn on the hole for holes which are not closest to an end of the body.

15. A dielectric ceramic body in accordance with claim 1 in which dielectric material is removed from said body at the other of the first and second side surfaces in an area outside of a transverse tangent line drawn on the hole which is closest to an end of the body at a side opposite to said end of the body.

* * * * *

UNITED STATES PATENT AND TRADEMARK OFFICE

CERTIFICATE OF CORRECTION

PATENT NO. : 4,806,889

DATED : February 21, 1989

INVENTOR(S) : Fumihito NAKANO et al.

It is certified that error appears in the above-identified patent and that said Letters Patent is hereby corrected as shown below:

In column 1, line 21, "resonator" is changed to --filter-- and "reso" is deleted; and
line 22, "nator" is changed to --filter--.

In column 4, line 46, "44, 45, and 46" is changed to --44 and 45--;
line 49, "44, 45 and 46" is changed to --44 and 45--; and
line 64, "44, 45 and 46" is changed to --44 and 45--.

In column 5, line 5, "44, 45 and 46" is changed to --44 and 45--.

In column 6, lines 4 and 5, "$b_{n-2}$, $b_{n-1}$ and $b_n$" is changed to --$b_{N-2}$, $b_{N-1}$ and $b_N$--;
line 8, "s-3, $s_{n-2}$ and $s_{n-1}$ is changed to --$s_{N-3}$, $s_{N-2}$ and $s_{N-1}$--;
line 18, "(N-1)/2" is changed to --N-1--;
line 21, "N-1" is changed to --N-2--; and
line 22, "N-2" is changed to --N-3--.

In column 6, line 17, "a largest" is changed to -- an --.

UNITED STATES PATENT AND TRADEMARK OFFICE

CERTIFICATE OF CORRECTION

PATENT NO. : 4,806,889

DATED : February 21, 1989

INVENTOR(S) : Fumihito NAKANO et al.

It is certified that error appears in the above-identified patent and that said Letters Patent is hereby corrected as shown below:

In column 8, line 40, "N" is changed to --N-1;
line 47, "a largest" is changed to --an--;
line 48, "(N-1)/2" is changed to --N-1--;
line 50, "N-1" is changed to --N-2--; and
line 51, "N-2" is changed to --N-3--.

Signed and Sealed this

Twenty-sixth Day of December, 1989

*Attest:*

JEFFREY M. SAMUELS

*Attesting Officer*

*Acting Commissioner of Patents and Trademarks*